US007770626B2

(12) United States Patent
Yashiro et al.

(10) Patent No.: US 7,770,626 B2
(45) Date of Patent: Aug. 10, 2010

(54) METHOD AND APPARATUS FOR SPRAYING RELEASE AGENT IN DIE CASTING MACHINE

(75) Inventors: Masaki Yashiro, Ebina (JP); Hiroshi Yokoyama, Ebina (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 827 days.

(21) Appl. No.: 11/615,066

(22) Filed: Dec. 22, 2006

(65) Prior Publication Data

US 2007/0154648 A1 Jul. 5, 2007

(30) Foreign Application Priority Data

Dec. 26, 2005 (JP) ..... 2005-371578

(51) Int. Cl.
*B22D 17/32* (2006.01)
*B22D 27/00* (2006.01)

(52) U.S. Cl. ..... 164/72; 164/113; 164/268; 164/312

(58) Field of Classification Search ..... 164/72, 164/74, 113, 267, 312
See application file for complete search history.

(56) References Cited

U.S. PATENT DOCUMENTS 4,759,703 A * 7/1988 Krebser et al. ..... 425/90

FOREIGN PATENT DOCUMENTS

| | | |
|---|---|---|
| JP | 07-214277 | 8/1995 |
| JP | 08-323456 | 12/1996 |
| JP | 9-182946 | 7/1997 |
| JP | 2003-290901 | 10/2003 |
| JP | 2005-279715 | 10/2005 |

OTHER PUBLICATIONS

Office Action issued in foreign counterpart Korean Application No. 10-2006-0132778, mailed Nov. 26, 2007.
English language abstract of JP 07-214277, published Aug. 15, 1995.
English language abstract of JP 08-323456, published Dec. 10, 1996.
English language abstract of JP 2003-290901, published Oct. 14, 2003.
English language abstract of JP 2005-279715, published Oct. 13, 2005.

* cited by examiner

*Primary Examiner*—Kuang Lin
(74) *Attorney, Agent, or Firm*—DLA Piper LLP US

(57) ABSTRACT

A release agent spray method and apparatus for a die casting machine. As a movable die plate is moved in a die closing direction, a spray head is moved in a perpendicular direction to a spray position. The movable die plate is stopped when it has reached a position at which the distance between the spray head and a die cavity surface of a movable die and the distance between the spray head and die cavity surface of a fixed die both become equal to a spray distance. A release agent is sprayed from the spray head onto the cavity surfaces of the movable die and the fixed die.

14 Claims, 5 Drawing Sheets

METHOD AND APPARATUS FOR SPRAYING RELEASE AGENT IN DIE CASTING MACHINE

BACKGROUND OF THE INVENTION

1. Field of the Invention

The present invention relates to a method and an apparatus for spraying a release agent in a die casting machine, and more particularly to a method and an apparatus for spraying a release agent onto a die cavity surface in a die casting machine which employs a servo motor-driven, electrically-powered die clamping apparatus capable of positioning a movable die plate at any position in die opening/closing directions.

2. Background Art

A technique for spraying a release agent or a heat retaining agent (hereinafter referred to simply as a release agent) onto a metal cavity surface in a die casting machine is known, as disclosed in, for example, Japanese Patent Laid-Open Publication No. 9-182946. The patent publication describes provision of a spray head having spray nozzles, which is movable in the die opening/closing directions of a die consisting of a movable die and a fixed die. A stand-by position of the spray head is set at a position from which the spray head can approach a position between the movable die and the fixed die when the dies are open.

The spray head is designed to move in the die opening/closing directions according to the thicknesses of the movable and fixed dies and also move to or approach a position between the movable and fixed dies. Spraying after the approach of the spray head is required to be carried out with an appropriate spray distance between the spray head and the die cavity surface of each die. In case of an inappropriate spray distance, a release agent would be sprayed from the spray head in a relatively large amount onto one cavity surface, whereas the release agent would be sprayed in a relatively small amount onto the other cavity surface.

In such a conventional spray apparatus for a release agent, the setting of a spray distances to each of fixed and movable dies is generally practiced by moving a spray head in the die opening or closing direction when the dies are open so as to position the spray head at a predetermined position in the die opening or closing direction.

This requires a mechanism for moving and positioning the spray head in the die opening/closing directions, and the cost of such a mechanism should necessarily be higher for setting of the spray distance with higher precision. Furthermore, the spray apparatus needs to perform the two-step operation of: moving the spray head in the die opening or closing direction from a stand-by position to position the spray head at an approach start position; and moving the spray head to a position between the fixed die and the movable die. Such a two-step operation has the problem of long cycle time.

SUMMARY OF THE INVENTION

It is therefore an object of the present invention to solve the above problems in the prior art and provide a release agent spray method and apparatus which, by utilizing the servo function of a servo motor-driven, electrically-powered die clamping apparatus capable of positioning a movable die plate at any position in die opening/closing directions, makes it possible to shorten the cycle time of a spraying process and to simplify the construction of the spray apparatus.

In order to achieve the object, the present invention provides a method for spraying a release agent in a die casting machine including a fixed die plate, a movable die plate, a die composed of a fixed die secured to the fixed die plate and a movable die secured to the movable die plate, an electrically-powered clamping apparatus which drives with a servo motor a die opening/closing mechanism for moving the movable die plate, and a spray device provided with a movement device for moving a spray head, which is to spray a release agent or a heat retaining agent, from a stand-by position outside the die to an arbitrary position between the fixed die and the movable die, said method comprising the steps of: installing the spray device on the movable die plate or the fixed die plate such that the direction of the movement of the spray head from the stand-by position outside the die to a position between the movable die and the fixed die is perpendicular to the direction of movement of the movable die; setting a spray position between the fixed die and the movable die based on a preset spray distance and the thicknesses of the fixed and movable dies, said spray position being such as to ensure the spray distance between the spray head and the die cavity surface of each of the fixed and movable dies; moving the movable die plate in the die closing direction and, at the same time, moving the spray head toward the spray position and positioning the spray head at the spray position; stopping the movement of the movable die plate when it has reached a position which lies within the stroke of the movable die plate and at which the distance between the spray head and the die cavity surface of the movable die and the distance between the spray head and the die cavity surface of the fixed die both become equal to the spray distance, thereby positioning the movable die plate at that position; spraying a release agent from the spray head onto the cavity surfaces of the movable die and the fixed die; and moving the movable die in the die opening direction and, at the same time, retreating the spray head to the stand-by position.

The present invention also provides an apparatus for spraying a release agent in a die casting machine including a fixed die plate, a movable die plate, a die composed of a fixed die secured to the fixed die plate and a movable die secured to the movable die plate, and an electrically-powered clamping apparatus which moves the movable die plate and drives with a servo motor a die opening/closing mechanism, comprising: means for setting a spray position between the fixed die and the movable die based on a preset spray distance and the thicknesses of the fixed and movable dies, said spray position being such as to ensure the spray distance between a spray head and the die cavity surface of each of the fixed and movable dies; a spray device including the spray head for spraying a release agent, and a movement device for moving the spray head between a stand-by position outside the die and the preset spray position between the fixed die and the movable die; and a servo control means for stopping the movement of the movable die plate when it has reached a position which lies within the stroke of the movable die plate and at which the distance between the spray head and the die cavity surface of the movable die and the distance between the spray head and the die cavity surface of the fixed die both become equal to the spray distance, thereby positioning the movable die plate at that position.

In a preferred embodiment of the present invention, the spray apparatus further comprises a sequence control means for controlling in a predetermined order the sequence of the operations of: moving the movable die plate from its die opening limit position in the die closing direction and, at the same time, moving the spray head from the stand-by position toward the spray position between the movable die and the fixed die; positioning the spray head at the spray position; stopping the movement of the movable die plate when it has reached a position at which the distance between the spray head and the die cavity surface of the movable die and the distance between the spray head and the die cavity surface of the fixed die both become the spray distance, thereby positioning the movable die plate at that position; spraying a release agent or a heat retaining agent from the spray head, and stopping the spraying; and retreating the spray head to the stand-by position.

DETAILED DESCRIPTION OF THE PREFERRED EMBODIMENTS

Preferred embodiments of the present invention will now be described with reference to the drawings.

Figure 1:
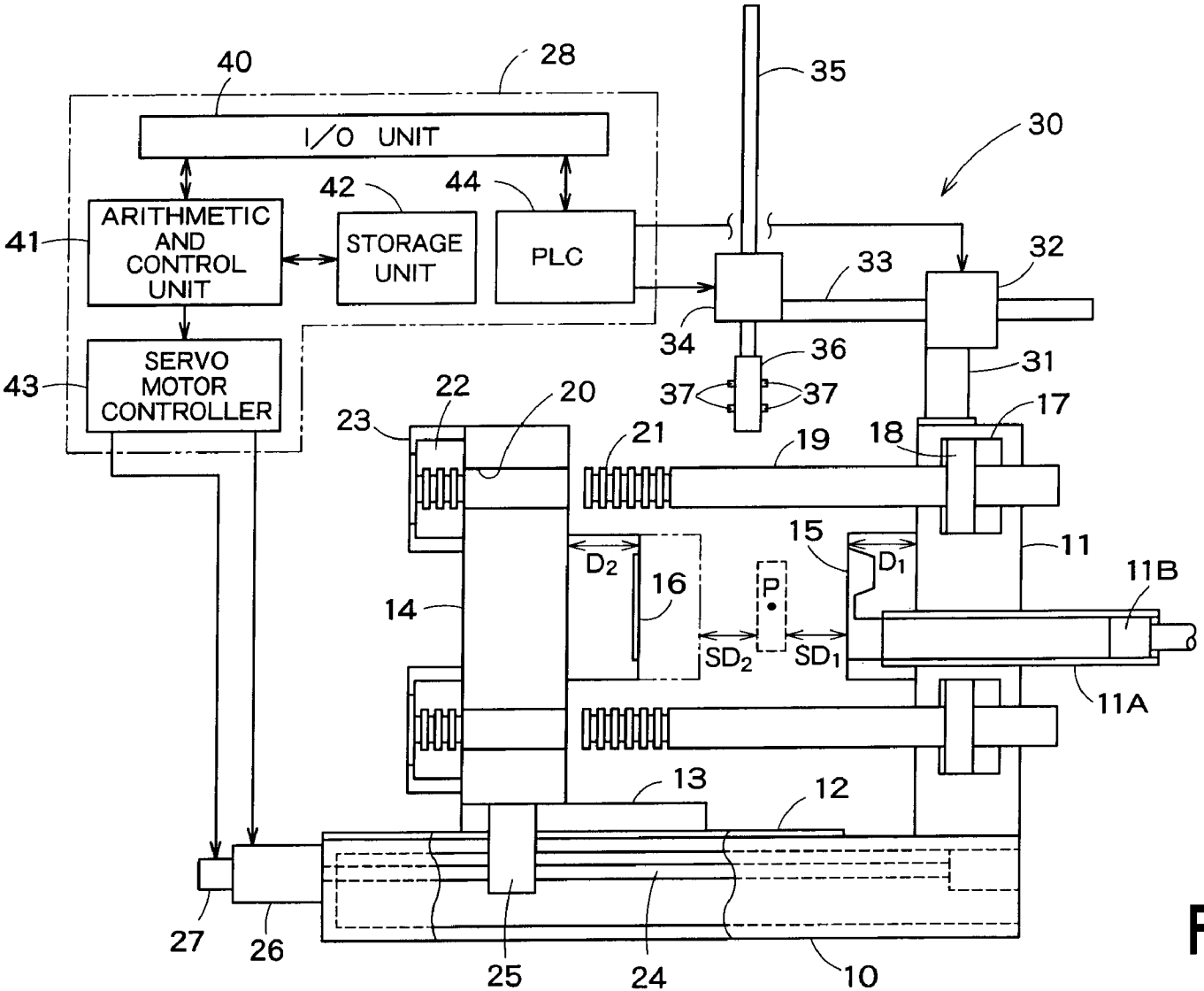
FIG. 1 is a schematic view, partly broken away, of the die clamping apparatus of a die casting machine to which a spray device according to the present invention is applied.

FIG. 1 shows a die casting machine which employs a spray apparatus according to the present invention. In FIG. 1, reference numeral 10 denotes a base on which, at its right end in FIG. 1, is fixed a die plate 11. On the upper surface of the base 10 are provided two parallel guides 12 disposed on the near and far sides and extending right and left in FIG. 1. A slider 13, which slidably engages with the guides 12, is fixed to the lower end of a movable die plate 14. In FIG. 1, reference numeral 11A denotes an injection sleeve and 11B denotes an injection plunger.

The fixed die plate 11 and the movable die plate 14 are disposed opposite to each other, to which are respectively mounted a fixed die 15 and a movable die 16 which pair off. Die clamping cylinders 17 are provided in the four corners of the fixed die plate 11. The right and left directions in FIG. 1 correspond to die closing (clamping) and die opening directions (hereinafter referred to simply as die opening/closing directions), respectively, in which the movable die plate 14 moves along the guides 12. Each die clamping cylinder 17 has a die clamping piston 18. A piston rod 19 extends from the die clamping piston 18 toward the movable die plate 14 in the die opening/closing directions, constituting a so-called tie bar for die clamping (piston rod 19 is hereinafter called tie bar 19).

In the four corners of the movable die plate 14 are formed through-holes 20 that releasably receive the tie bars 19. The tie bar 19 has at its front end a plurality of ring-shaped grooves (or spiral thread grooves) 21 formed at regular intervals. Half nuts 22, which can releasably engage the grooves 21, are provided on the back side of the movable die plate 14. The half nuts 22 are provided in pairs, and each pair is designed to move along a guide 23 by means of a not-shown drive device so that the pair of half nuts 22 opens/closes perpendicularly to the view of FIG. 1.

A die opening/closing mechanism for moving the movable die plate 14 will now be described.

A ball feed screw 24, extending parallel to the die opening/closing directions, is mounted in the base 10. A feed nut 25 mounted to the movable die plate 14 engages the ball feed screw 24. The ball feed screw 24 is driven by a servo motor 26 provided with an encoder 27 and is designed to be capable of moving the movable die plate 14 a predetermined distance at a predetermined speed in the die opening/closing directions by means of the servo mechanism of a control device 28 so as to position the movable die plate 14 at an arbitrary position.

On the other hand, a large movement of the movable die plate 14, i.e. movement with a stroke corresponding to the distance between the die opening limit position and the die closing position of the movable die 16, is performed by means of a die opening/closing mechanism driven by a servo motor 25. The movable die 16 in the die closing position is at a stop close to the fixed die 16. The die clamping apparatus of this embodiment is a so-called electrically-powered composite die clamping apparatus, and performs die clamping of the movable die 16 and the fixed die 15 by pulling the tie bars 19 by means of the die clamping cylinders 17 with the grooves 21 of the tie bars 19 in engagement with the half nuts 22.

A description will now be given of a spray device 30 for spraying a release agent onto the die cavity surfaces of the fixed die 15 and the movable die 16.

In this embodiment the spray device 30 is mounted on the fixed die plate 11 via a bracket 31. The spray device 30 includes an orthogonal movement mechanical for moving a spray head 36 in two orthogonal directions.

The orthogonal movement mechanism includes a first drive device 32 for moving the spray head 36 horizontally in the die opening/closing directions, and a second drive device 34 for moving the spray head 36 in the vertical direction. The first drive device 32 incorporates an actuator capable of driving a horizontal bar 33 to move it an arbitrary distance. The second drive device 34 is supported on the front end of the horizontal bar 33. The second drive device 34 incorporates an actuator capable of driving a vertical bar 35 to advance and retreat it an arbitrary distance in the vertical direction between the fixed mold 15 and the movable mold 16. The spray head 36 is held at the lower end of the vertical bar 35. Spray nozzles 37 are disposed on both sides of the spray head 36. The spray head 36 is designed to spray a release agent or a heat retaining agent toward the die cavity surfaces of the fixed die 15 and the movable die 16 with predetermined spray conditions, such as flow rate, spray pressure, spray time, etc.

The control device 28 will now be described with reference to FIG. 1. The control device 28 basically comprises an input/output unit 40, an arithmetic and control unit 41, a storage unit 42, a servo motor controller 43, and a PLC (programmable logic controller) 44.

Data on the thicknesses D1, D2 of the fixed die 15 and the movable die 16 and on a so-called spray distance SD1,SD2 from the spray head 36 to the die cavity surface of each of the fixed die 15 and the movable die 16 is inputted from an input device 45 via the input/output unit 40 to the arithmetic and control unit 41. The arithmetic and control unit 41 calculated a spray position P, at which the spray head 36 is to be positioned, from the thicknesses D1, D2 of the fixed die 15 and the movable die 16 and the spray distances SD1,SD2. The arithmetic and control unit 41 also calculates a position of the movable die plate 14 at which the distance between the spray head 36 and the die cavity surface of the movable die 16 becomes equal to the spray distance SD2.

Upon start of a spraying process, the arithmetic and control unit 41 instructs the servo motor controller 43 on the above-calculated target position for movement of the movable die plate 14. The servo motor controller 43 controls the servo motor 26 and, while detecting a position of the movable die plate 14 with the encoder and comparing the detected position with the target position, moves the movable die plate 14 to the target position to position it at the target position at which the distance between the spray head 36 and the die cavity surface of the movable die 16 becomes equal to the spray distance SD2.

The arithmetic and control unit 41 is also connected to the PLC 44. The PLC 44 controls the operation of the spray device 30 according to the sequence shown in FIG. 4. In particular, the PLC 44 actuates the first drive device 32 to advance and retreat the horizontal bar 33, and activates the second drive device 34 to raise and lower the vertical bar 35, so that the spray head 36 can be moved in a predetermined path between a stand-by position as shown in FIG. 1 and a preset spray position lying between the fixed die 15 and the movable die 16, as will be described in more detail below.

Figure 4:
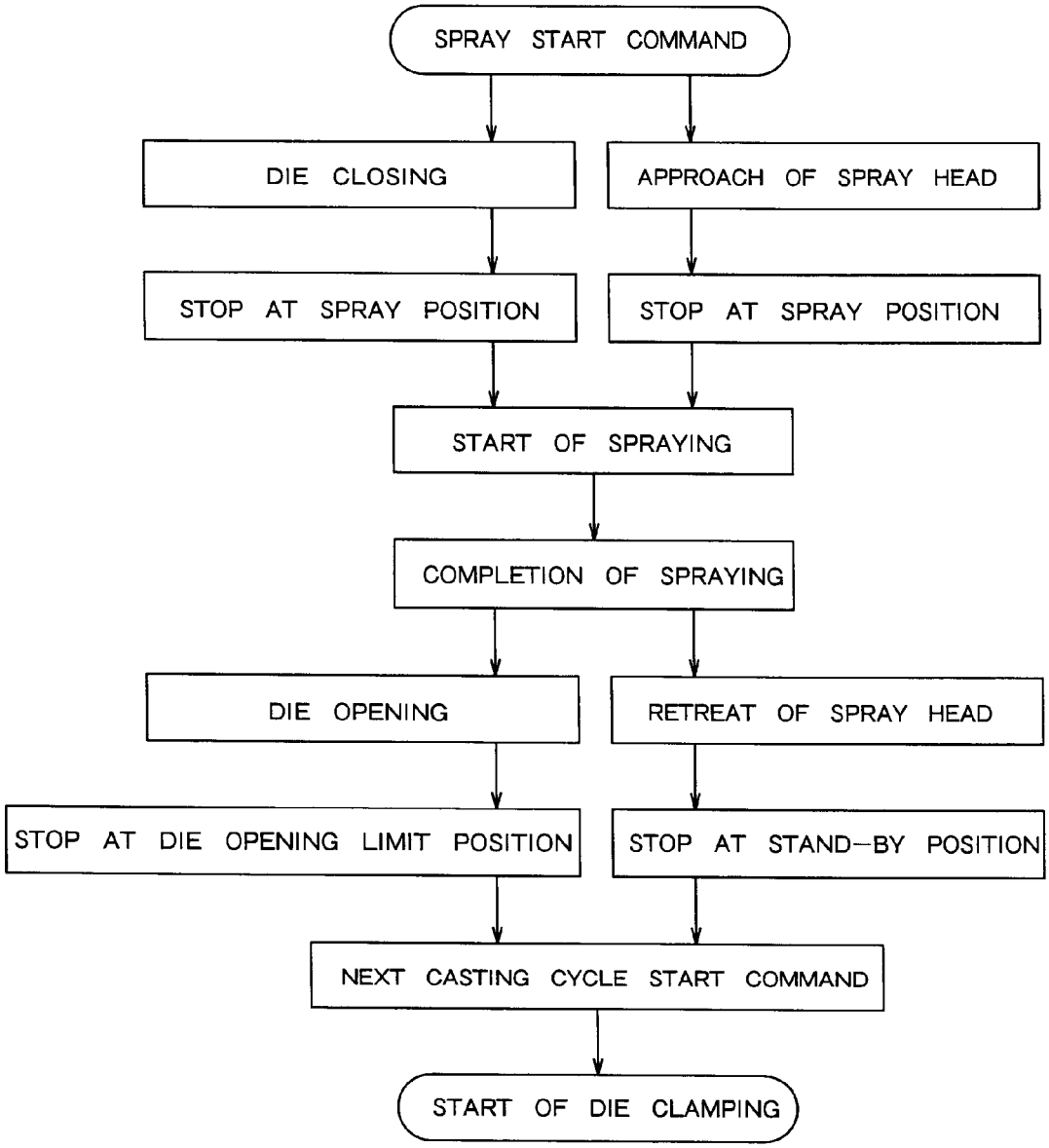
FIG. 4 is a flow chart of the sequence of a spraying process.

The operation of a spray apparatus according to the present invention in association with the progress of a spraying process will now be described with reference to the sequence of FIG. 4.

When the fixed die 15 and the movable die 16 are replaced with new dies 15 and 16 having different die thicknesses from the old ones, the previous spray distance must be reset upon the replacement since otherwise a release agent could not be sprayed evenly onto the die cavity surfaces of the new dies. Appropriate spray distances SD1,SD2, suited for the new dies, is set based on stored experimental data. A following description will refer to a case where the spray distance SD1 is different from SD2. But, according to shapes of molds, the spray distance SD1 can be equal to SD2.

The thicknesses D1, D2 of the fixed die 15 and the movable die 16 and spray distances SD1,SD2 for the dies 15, 16 are inputted to the control device 28.

Next, the arithmetic and control unit 41 sets a spray position P, at which the spray head 36 is to be positioned, based on the thicknesses D1, D2 of the fixed and movable dies 15, 16 and the spray distances SD1,SD2. The arithmetic and control unit 41 also calculates a target position for movement of the movable die plate 14 at which the distance between the die cavity surface of the movable die 16 and the spray head 36 in the spray position becomes equal to the spray distance SD2.

Figure 2:
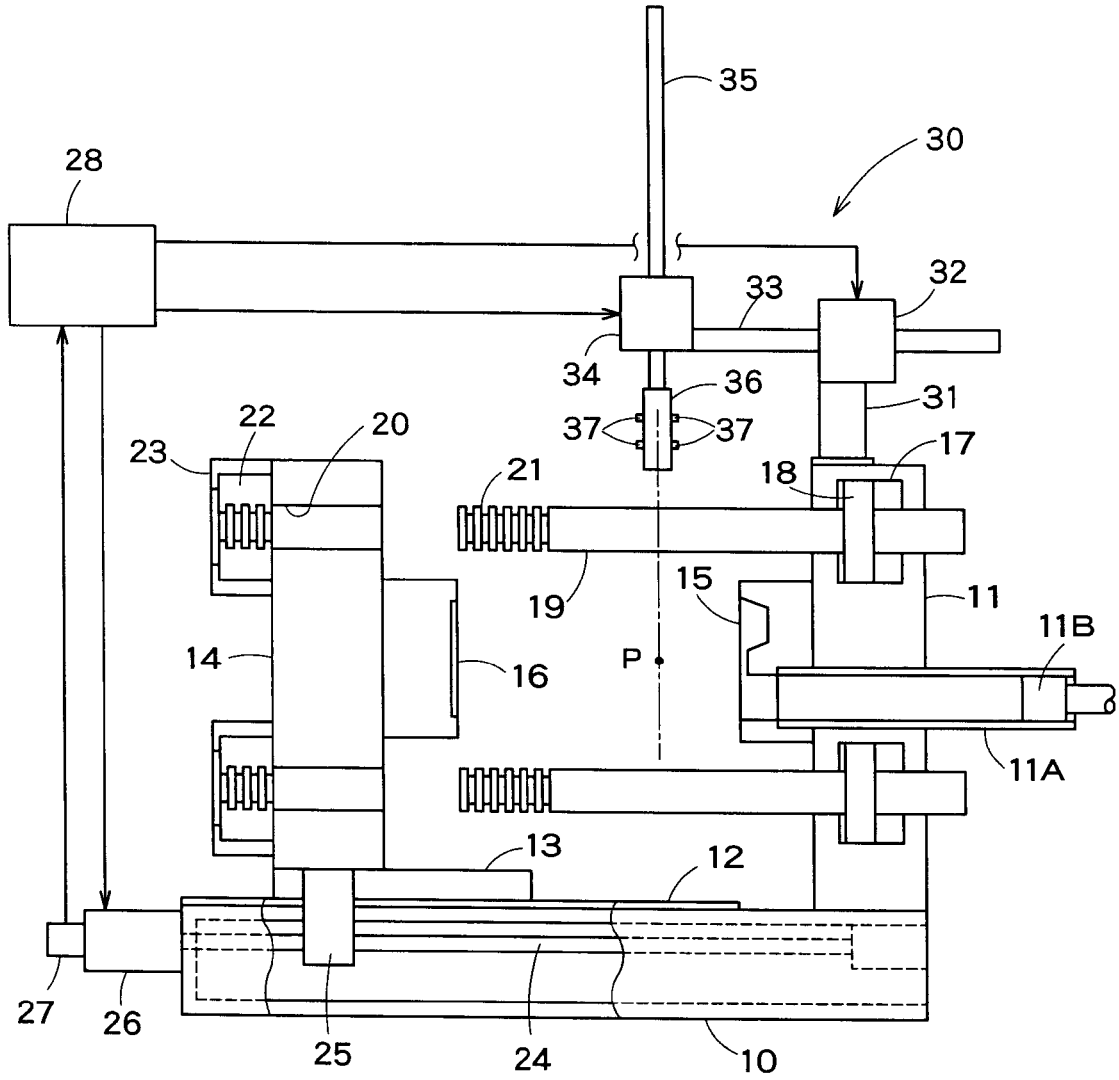
FIG. 2 is a schematic view corresponding to FIG. 1, illustrating the die clamping apparatus when the spray head of the spray device is in a stand-by position and the movable die is in a die opening limit position.

Prior to starting casing cycles with the new fixed die 15 and movable die 16, the stand-by position of the spray head 36 is adjusted. In association with the change of the spray distances SD1,SD2, the stand-by position of the spray head 36 is adjusted so as to respond to the thickness D1 of the fixed die 15 and the spray distance SD1 with respect to the fixed die 15. In this embodiment the first drive device 32 is actuated by means of the PLC 44 to move the horizontal bar 33 in the die opening or closing direction and position the spray head 36 at a stand-by position right above the new spray position P, as shown in FIG. 2. The new stand-by position is fixed during the series of casting cycles. The distance of movement of the spray head 36, driven by the second drive device 34, between the stand-by position and the spray position P is the same as before.

Next, a casting cycle operation is started. Between casting cycles there are intervals when the movable die plate 14 is open and lies in the die opening limit position shown in FIG. 2.

During an interval, a spraying start command is sent from a not-shown control panel of the die casting machine to the control device 28 with appropriate timing. Thereafter, the spray head 36 and the movable die plate 14 operate in the sequence shown in FIG. 4, as follows:

The PLC 44, on receipt of the spraying start command, activates the second drive device 34 of the spray device 30 to lower the vertical bar 35. The spray head 36 moves from the stand-by position outside the die toward the preset spray position P between the fixed die 15 and the movable die 16. The spray head 36 descends straight from the stand-by position to the spray position P via the shortest distance and stops at the spray position R The spray head 36 in the spray position P is kept precisely at the spray distance SD1 from the fixed die 15.

Figure 3:
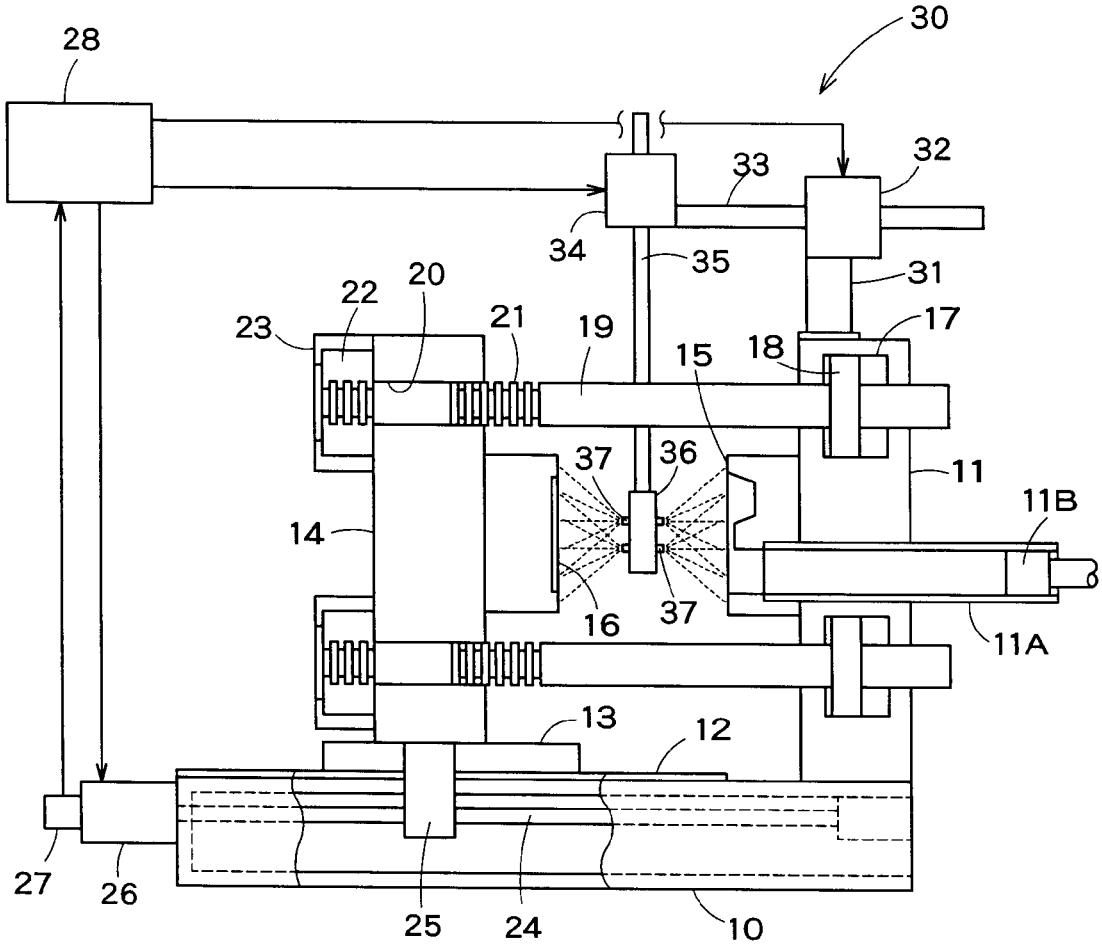
FIG. 3 is a schematic view corresponding to FIG. 1, illustrating the die casting apparatus when the spray head of the spray device is in a spray position.

Simultaneously with the approaching operation of the spray head 36, the PLC 44 sends a signal to actuate the servo motor 26 to the servo motor controller 43, whereby the movement of the movable die plate 14 in the die closing direction is started. During the movement of the movable die plate 14, a position of the movable die plate 14 is detected with the encoder 27 and the detected position is fed back to the servo motor controller 43. The servo motor 26 is stopped when the movable die plate 14 has reached the position shown in FIG. 3, i.e. the position at which the distance between the spray head 36 and the die cavity surface of the movable die 16 becomes equal to the spray distance SD2, thereby positioning the movable die 16 at that position at which the spray distance SD2 is secured precisely.

Next, a release agent is sprayed from the nozzles 37 of the spray head 36 in the spray position P onto the die cavity surfaces of the fixed die 15 and the movable die 16 for a predetermined time.

On completion of the spraying, the PLC 44 again actuates the servo motor 26 to start the die opening operation of moving and returning the movable die plate 14 to the die opening limit position. At the same time, the PLC 44 actuates the second drive device 34 of the spray device 30 to start the operation of raising the vertical bar 35 so as to retreat the spray head 36 to the stand-by position shown in FIG. 2.

Finally, the spray head 36 stops at the stand-by position and the movable die plate 14 stops at the die opening limit position. Thereafter, upon issuance of a command to start the next casting cycle, the movable die plate 14 moves in the die closing direction, and a die clamping operation is started.

According to this embodiment, the spray head 36 can thus be positioned at a position which ensures an appropriate spray distance simply by the approaching operation of moving the spray head 36 from a stand-by position to the position between the movable die 16 and the fixed die 15. Thus, there is now no need to carry out the operation of moving the spray head 36 in the die opening or closing direction in order to secure an appropriate spray distance, as is needed for each spraying process in the conventional technique. It becomes possible with the present invention to simultaneously start the movement of moving the movable die plate 14 in the die closing direction and the approaching movement of the spray head 36, which can shorten the cycle time of a spraying process.

Furthermore, since the setting of spray distance is performed precisely by control of the servo motor 26 of the electrically-powered die clamping apparatus, there is no need for the setting of spray distance on the spray device 30 side. This can eliminate the need for a device for positioning of a spray head as needed conventionally, thus simplifying the construction of the spray device 30.

Since in this embodiment the setting of a stand-by position of the spray head 36 is necessary only once after die replacement and before entering into a casting operation, it is also possible to adjust the first drive device 32 manually.

Though in this embodiment the spray device 30 is installed on the fixed die plate 11, the spray device 30 may be installed in any appropriate location on the fixed die plate side, such as on the base 10 or on the floor on which the base 10 is installed.

Figure 5:
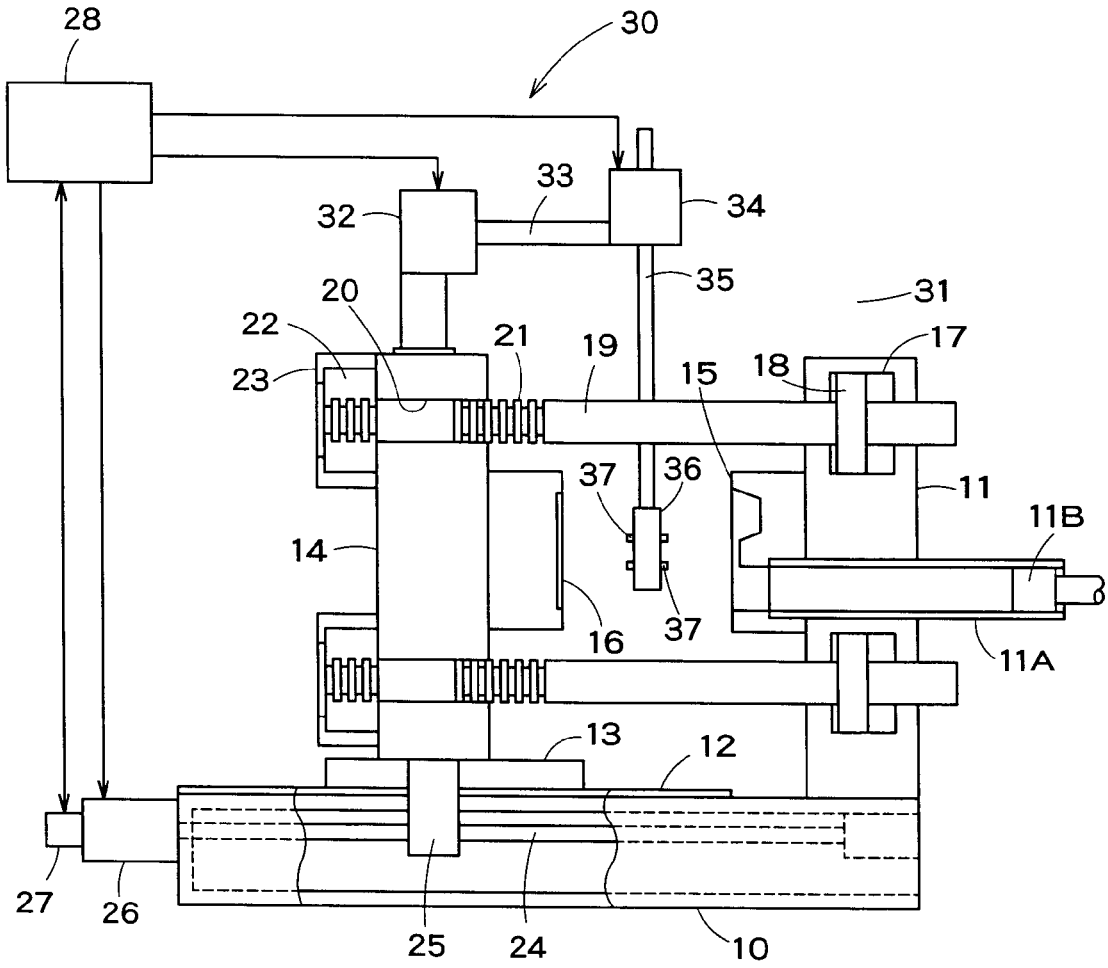
FIG. 5 is a schematic view corresponding to FIG. 1, illustrating an embodiment in which the spray device is installed on the movable die.

FIG. 5 shows an embodiment in which the spray device 30 is installed on the movable die plate 14. In this case, the first drive device 32 adjusts the stand-by position of the spray head 36 based on the thickness D2 of the movable die 16 and a spray distance SD from the spray head 36 to the movable die 16. When the spray head 36 is lowered in a straight path from the stand-by position to a spray position, the spray head 36 in the spray position is held at the spray distance SD from the fixed die 15.

On the other hand, a position at which the movable die plate 14 is to be stopped is determined based on the thickness D1 of the fixed die 15 and the spray distance SD with respect to the fixed die 15. At the movable die plate stop position, the distance between the spray head 36 and the die cavity surface of the fixed die 15 is equal to the spray distance SD.

Though in the above-described embodiments the orthogonal movement mechanism, comprising the first and second drive devices 32, 34, is employed in the spray device 30, the same effect will be obtained with a spray device that employs a multi-linkage robot arm.

Though in the above-described embodiments is used a so-called composite die clamping apparatus, which uses the servo motor 26 and the ball feed screw 24 for die opening/closing in combination with the die clamping cylinder 17 for final die clamping, the present invention is of course not limited to the use of such a composite die clamping apparatus.

Thus, the present invention is applicable also to a die casting machine which opens/closes a die by means of a toggle-type die clamping apparatus which drives a toggle linkage mechanism with a servo motor. The present invention is also applicable to various other die casting machines which employ an electrically-powered die clamping apparatus capable of positioning a movable die plate at any desired position by control of a servo motor.

What is claimed is:

1. A method for spraying a release agent in a die casting machine including a fixed die plate, a movable die plate, a die composed of a fixed die secured to the fixed die plate and a movable die secured to the movable die plate, an electrically-powered clamping apparatus which drives with a servo motor a die opening/closing mechanism for moving the movable die plate, and a spray device provided with a movement device for moving a spray head, which is to spray a release agent or a heat retaining agent, from a stand-by position outside the die to an arbitrary position between the fixed die and the movable die, said method comprising the steps of:

installing the spray device on the movable die plate or the fixed die plate such that the direction of the movement of the spray head from the stand-by position outside the die to a position between the movable die and the fixed die is perpendicular to the direction of movement of the movable die;

setting a spray position between the fixed die and the movable die based on a preset spray distance and the thicknesses of the fixed and movable dies, said spray position being such as to ensure the spray distances between the spray head and the die cavity surface of each of the fixed and movable dies;

moving the movable die plate in the die closing direction and, at the same time, moving the spray head toward the spray position and positioning the spray head at the spray position;

stopping the movement of the movable die plate when it has reached a position which lies within the stroke of the movable die plate and at which the distance between the spray head and the die cavity surface of the movable die and the distance between the spray head and the die cavity surface of the fixed die both become equal to the spray distances, thereby positioning the movable die plate at that position;

spraying a release agent from the spray head onto the cavity surfaces of the movable die and the fixed die; and moving the movable die in the die opening direction and, at the same time, retreating the spray head to the stand-by position.

2. The method for spraying a release agent according to claim 1, wherein the movement of the spray head toward the spray position and the movement of the movable die plate are started simultaneously when the movable die plate lies in its die opening limit position.

3. The method for spraying a release agent according to claim 1, wherein the spray device is installed on the fixed die plate, the spray head is moved in a straight path from the stand-by position to the spray position, and the distance between the spray head in the spray position and the cavity surface of the fixed die is kept at the preset spray distance.

4. The method for spraying a release agent according to claim 1, wherein the spray device is installed on the movable die plate, the spray head is moved in a straight path from the stand-by position to the spray position, and the distance between the spray head in the spray position and the cavity surface of the movable die is kept at the preset spray distance.

5. The method for spraying a release agent according to claim 3 or 4 further comprising the step of adjusting the stand-by position of the spray head in accordance with said spray position after die replacement and before starting a first casting cycle.

6. An apparatus for spraying a release agent in a die casting machine including a fixed die plate, a movable die plate, a die composed of a fixed die secured to the fixed die plate and a movable die secured to the movable die plate, and an electrically-powered clamping apparatus which moves the movable die plate and drives with a servo motor a die opening/closing mechanism, comprising:

means for setting a spray position between the fixed die and the movable die based on preset spray distances and the thicknesses of the fixed and movable dies, said spray position being such as to ensure the spray distance between a spray head and the die cavity surface of each of the fixed and movable dies;

a spray device including the spray head for spraying a release agent, and a movement device for moving the spray head between a stand-by position outside the die and the preset spray position between the fixed die and the movable die; and a servo control means for stopping the movement of the movable die plate when it has reached a position which lies within the stroke of the movable die plate and at which the distance between the spray head and the die cavity surface of the movable die and the distances between the spray head and the die cavity surface of the fixed die both become equal to the spray distances, thereby positioning the movable die plate at that position.

7. The apparatus for spraying a release agent according to claim 6 further comprising a sequence control means for controlling in a predetermined order the sequence of the operations of: moving the movable die plate from its die opening limit position in the die closing direction and, at the same time, moving the spray head from the stand-by position toward the spray position between the movable die and the fixed die; positioning the spray head at the spray position;

stopping the movement of the movable die plate when it has reached a position at which the distance between the spray head and the die cavity surface of the movable die and the distance between the spray head and the die cavity surface of the fixed die both become the spray distance, thereby positioning the movable die plate at that position; spraying a release agent or a heat retaining agent from the spray head, and stopping the spraying; and retreating the spray head to the stand-by position.

8. The apparatus for spraying a release agent according to claim 6, wherein the drive device of the spray device is comprised of an orthogonal movement mechanism including a first drive device for moving the spray head in a direction parallel to the direction of the movement of the movable die plate, and a second drive device for moving the spray head toward the spray position in a direction perpendicular to the direction of movement of the movable die.

9. The apparatus for spraying a release agent according to claim 7, wherein the spray device is installed on the fixed die plate, the first drive device constitutes means for adjusting the stand-by position of the spray head according to the thickness of the fixed die, the second drive device moves the spray head in a vertical straight path from the stand-by position to the spray position, and the distance between the spray head in the spray position and the die cavity surface of the fixed die is kept equal to the spray distance regardless of the position of the movable die plate.

10. The apparatus for spraying a release agent according to claim 7, wherein the spray device is installed on the movable die plate, the first drive device constitutes means for adjusting the stand-by position of the spray head according to the thickness of the movable die, the second drive device moves the spray head in a vertical straight path from the stand-by position to the spray position, and the distance between the spray head in the spray position and the die cavity surface of the movable die is kept equal to the spray distance regardless of the position of the movable die plate.

11. The apparatus for spraying a release agent according to claim 6, wherein the drive device of the spray device is comprised of a multi-linkage robot arm.

12. The apparatus for spraying a release agent according to claim 7, wherein before simultaneously starting the movement of the spray head toward the spray position and the movement of the movable die plate in the die closing direction, the sequence control means sends a signal to start a spraying process to the spray device and the servo control means when the movable die plate lies in the die opening limit position.

13. The apparatus for spraying a release agent according to claim 6, wherein the electrically-powered clamping apparatus is a composite die clamping apparatus including a servo motor-driven ball screw feed mechanism, constituting the die opening/closing mechanism, and a die clamping cylinder which generates a die clamping force when the movable die is closed with respect to the fixed die, and wherein the servo control means controls a servo motor which drives the ball screw feed mechanism.

14. The apparatus for spraying a release agent according to claim 6, wherein the electrically-powered clamping apparatus is a toggle-type die clamping apparatus including a servo motor-driven ball screw feed mechanism, constituting the die opening/closing mechanism, and a servo motor-driven toggle linkage mechanism which generates a die clamping force when the movable die is closed with respect to the fixed die, and wherein the servo control means controls a servo motor which drives the toggle linkage mechanism.

* * * * *